US005521801A

United States Patent [19]

Pesau et al.

[11] Patent Number: 5,521,801

[45] Date of Patent: May 28, 1996

[54] LAMP WITH OBLONG LIGHTING MEANS AND REFLECTORS

[75] Inventors: Karin Pesau, Vienna; Georg Kempter, Bregenz, both of Austria

[73] Assignee: Zumtobel Licht GmbH, Dornbirm, Austria

[21] Appl. No.: 416,696

[22] Filed: Apr. 10, 1995

[30] Foreign Application Priority Data

Oct. 21, 1992 [DE] Germany ..... 9214199 U

[51] Int. Cl.[6] ..... F21S 1/02

[52] U.S. Cl. ..... 362/147; 362/217; 362/297; 362/346

[58] Field of Search ..... 362/147, 148, 362/217, 297, 346

[56] References Cited

U.S. PATENT DOCUMENTS

| | | | |
|---|---|---|---|
| 1,718,155 | 6/1929 | Klehr . | |
| 2,202,266 | 5/1940 | Phillips . | |
| 4,809,147 | 2/1989 | Negishi | 362/346 |
| 4,992,695 | 2/1991 | Naum | 362/346 |
| 5,097,401 | 3/1992 | Eppler | 362/346 |
| 5,357,413 | 10/1994 | Mandall | 362/346 |

*Primary Examiner*—Denise L. Gromada
*Assistant Examiner*—Alfred Basichas
*Attorney, Agent, or Firm*—Cooper & Dunham

[57] ABSTRACT

A lamp with at least one oblong means of lighting is mounted in a reflector cage which is attached beneath curved reflector surfaces. In order to attach the lamp directly to a ceiling, the reflector surfaces are given a roughly V-shaped front-view profile and their outer longitudinal leading edges extend to proximity with ceiling elements to which the lamp is fastened.

6 Claims, 3 Drawing Sheets

LAMP WITH OBLONG LIGHTING MEANS AND REFLECTORS

The invention relates to a lamp with at least one oblong lighting means and with at least two reflectors disposed above this/these, and a preferably partially transparent reflector cage disposed underneath the two reflectors, such that the reflector cage covers the lighting means.

Lamps of this type are known. Especially lamps with partially transparent reflector cages are distinguished by an especially pleasant lighting effect, i.e. a viewer gains a bright impression of the room although the illumination intensities are relatively low. The character of the illumination is almost that of daylight. Most of the time, such lamps are designed as concealed ceiling lamps, i.e. such lamps can be used only in conjunction with dropped ceiling systems. (Dropped ceilings require rooms with a certain minimum height.)

Lamps of this type have already become known, which can be attached on or also suspended from ceilings. A disadvantage of all these lamps is that the two reflectors disposed above the lighting means are designed in such a way that they are imaged on the ceiling as troublesome shadows.

The design of these lamps on the one hand is supposed to provide sufficient illumination intensity, but on the other hand this previous design of the lamps, especially of the reflectors, has the disadvantage that the latter often cast considerable shadows.

This also applies to the lamp corresponding to the U.S. Pat. No. 2,202,266. With this proposal, the reflector walls have a V-shaped profile and contact the ceiling at an acute angle. The resulting discontinuous or step-shaped protrusion causes shadows on the ceiling. This is especially troublesome because the height of the step-shaped protrusion which contacts the ceiling practically is not the same over the entire length of the lamp, so that the resulting shadow image on the ceiling is irregular.

The U.S. Pat No. 5,097,401 deals with a wall lamp which is designed with a reflector trough, and the light generated in the reflector trough is radiated into the room. This wall lamp generates purely indirect light, so that practically no shadow is formed. However, this light is not able to achieve the lighting effect mentioned above, since the light intensities of all the reflectors do not appear even approximately the same to a viewer. If the reflector cage is designed partially transparent to light, a portion of the light passes through the reflector, is preferentially scattered, so that the light intensity remains below the value of the lighting means used, and thus prevents the viewer from being exposed to glare.

It is the object of the invention to design a lamp of the type mentioned in the introduction, in such a fashion that this lamp can be attached directly to the ceiling and that the pleasant lighting effect remains preserved, without it forming troublesome shadows. Furthermore, this lamp should also be appropriate for use in rooms with video-screen workplaces.

To achieve this object, the invention is characterized by the technical teaching of claim 1.

The essential feature of the invention is that the reflector surfaces with the V-shaped profile have an approximately swept-wing-like profile as viewed from the front, their outer longitudinal leading edges extending close to the ceiling elements to which the lamp is fastened, in such a fashion that the transition region of the reflector surfaces in the region of the outer longitudinal leading edges contacts the surface of the ceiling elements tangentially. To prevent shadows from being formed, it is here important that the outer longitudinal leading edge is situated very close tithe ceiling elements. The reflector with the V-shaped profile must approach the ceiling tangentially without a step, i.e. without a step-like protrusion, at the longitudinal leading edge. Furthermore, the transition region of the reflector surfaces makes a tangential contact with the ceiling elements, in the region of the outer longitudinal leading edge, thus making it unnecessary for the height of the longitudinal leading edge to remain uniform.

Because the reflector surfaces are designed with the V-shape of a swept-back wing, it is now for the first time possible to attach the lamp directly on a ceiling, because the outer longitudinal leading edges of the reflector surfaces preferentially contact the ceiling.

The inventive reflector surfaces essentially also have a concave curvature.

One advantageous effect of the invention is that a lamp with the inventive reflectors is integrated harmoniously on the ceiling. This enhances the pleasant, quiet, daylight-like illuminating action of the lamp.

The inventive design of the reflector contour also lights up the ceiling and thus improves efficiency. (Light beams strike not only the reflectors but also directly strike the ceiling.)

There are several possibilities for designing reflector surfaces, all of which are included within the inventive idea of the invention.

In a first embodiment, the reflector surfaces are given a continuously curved design, and extend, with continuous curvature, from the inner longitudinal leading edges tithe outer longitudinal leading edges which contact the ceiling elements.

In a second modification, the reflector surfaces have a continuous curvature and can have a relatively steep curvature in the vicinity of the reflector cage. While overcoming a relatively small radius, this steep curvature goes over into a curve of lower curvature.

The transition region between the longitudinal leading edge close to the ceiling and the ceiling elements also can have various designs.

In a first modification, the tangent to the reflector surfaces in the region near the ceiling is caused to make contact with the ceiling surface, i.e. the reflector surface is caused to make a tangential transition to the ceiling surface.

In another modification, the tangent to the reflector surfaces in the region near the ceiling is caused to form an angle with the ceiling surface itself.

The subject of the present invention derives not only from the subject of the individual claims, but also from the combination of the individual claims with one another.

All specifications and features disclosed in the documents, including the abstract of the disclosure, and in particular the spatial arrangement shown in the drawings, are claimed as essential to the invention, to the extent that individually or in combination they are novel with respect to the prior art.

The invention is explained in more detail below in terms of several embodiments shown in the drawings. Further essential features and advantages of the invention here become apparent from the drawings and from their description.

Figure 1:
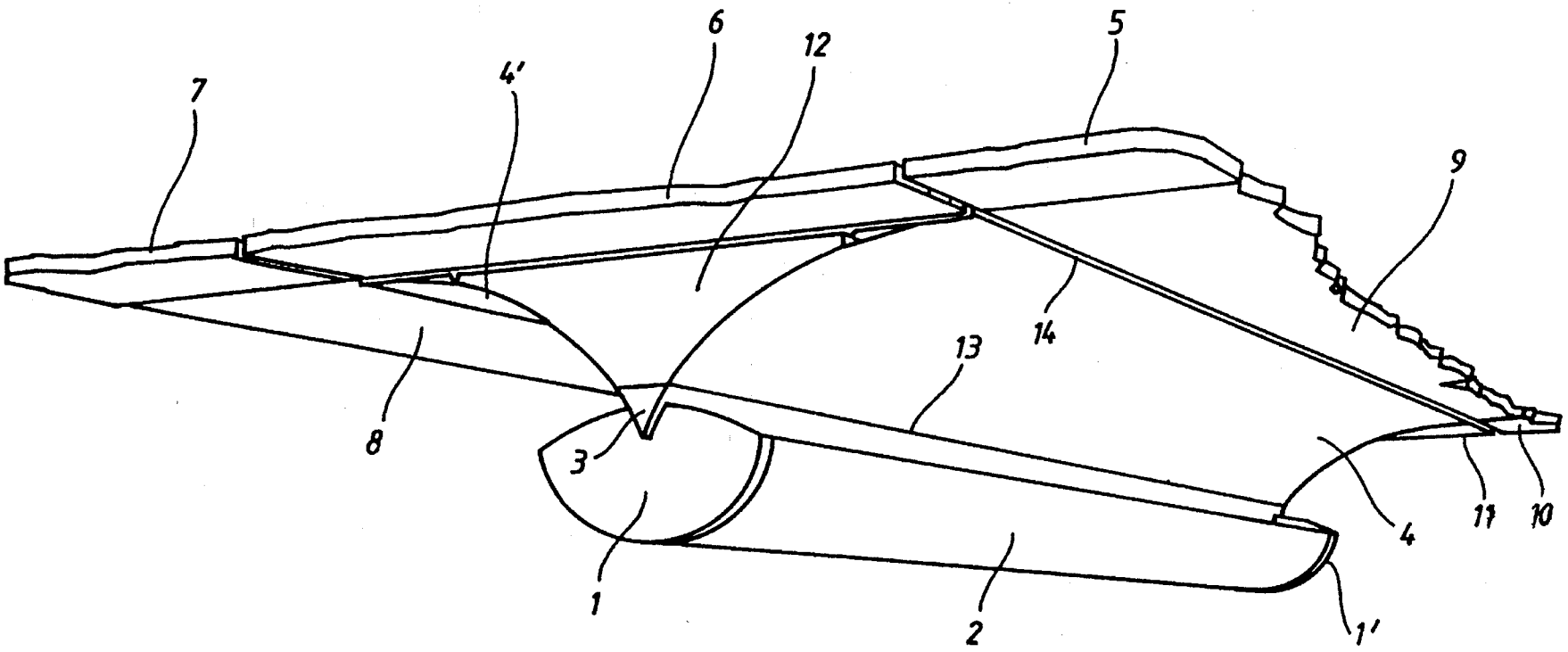
FIG. 1 shows the inventive lamp in a perspective view.
Figure 2:
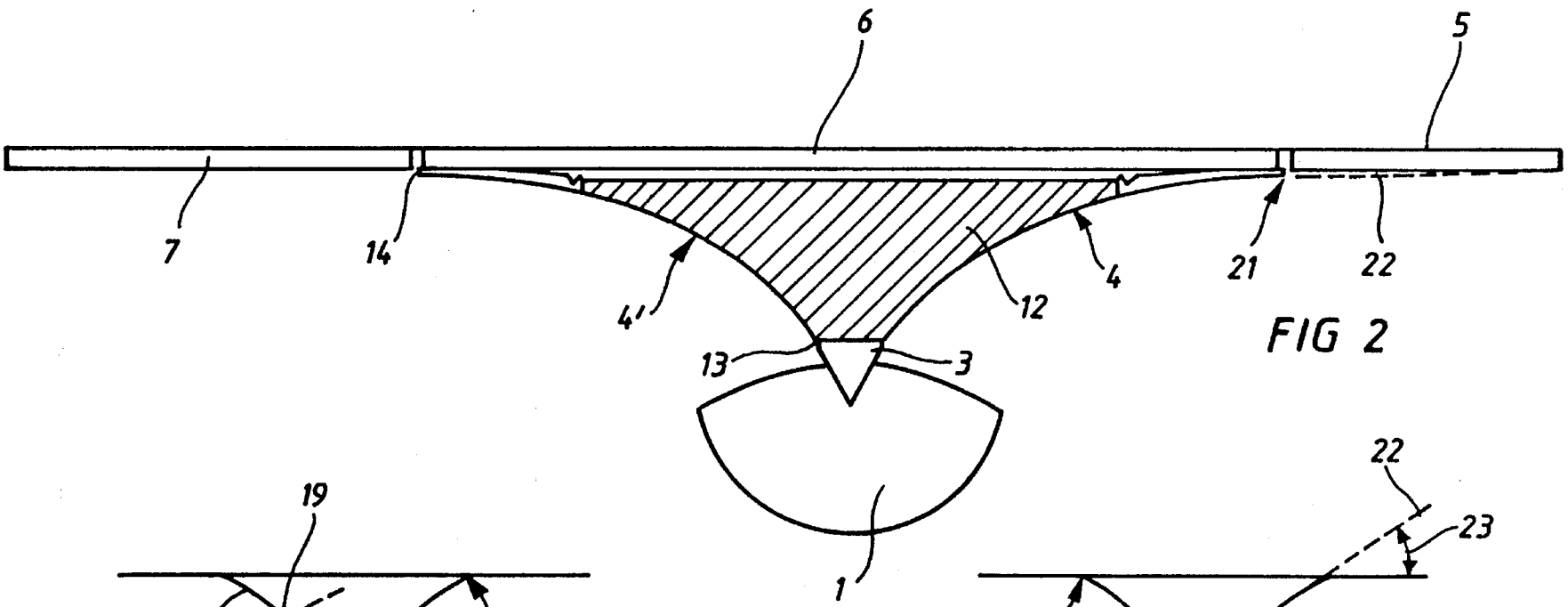
FIG. 2 shows the lamp of FIG. 1 in a cross-sectional view.

In a first embodiment of the lamp according to FIGS. 1 and 2, the lamp consists essentially of a reflector cage 2, whose front is covered by frontal cage parts 1, 1'. The reflector cage 2 preferably is made of perforated metal sheet with a matte or opaque foil behind it. It can be partially transparent or opaque.

The reflector cage 2 is fastened to a mounting rail 3, such that the operating devices of the lamp can be fastened either in a trough part or advantageously on the mounting rail.

The holders for one or more lamps are fastened to the respective frontal cage part 1, 1'. In this way, the lighting means are covered by the reflector cage 2.

The reflector cage 2 advantageously is fastened to the lamp by means of the mounting rail 3, the mounting rail 3 forming a part of the inventive reflector surfaces 4, 4'.

The trough part 12 usually is screwed on the ceiling. In the embodiment, the ceiling consists of slab-shaped ceiling elements 5–11.

The inner longitudinal leading edges 13 of the reflector surfaces 4, 4' extend above the reflector cage 2 and consequently are mirror-symmetric with respect to the longitudinal center axis of the reflector cage 2.

Figure 3:
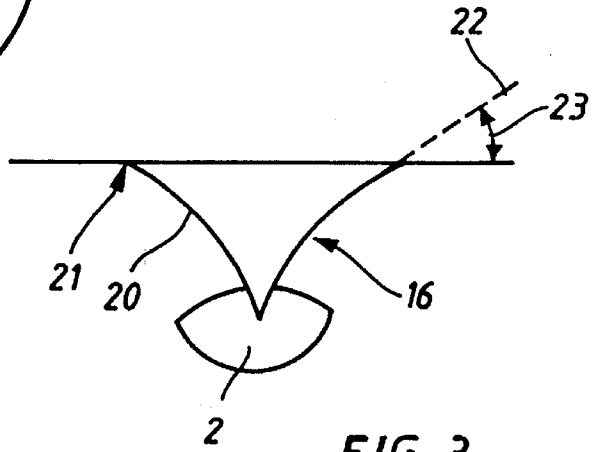
FIG. 3 is a representation similar to FIG. 2 with a modified lamp.
Figure 4:
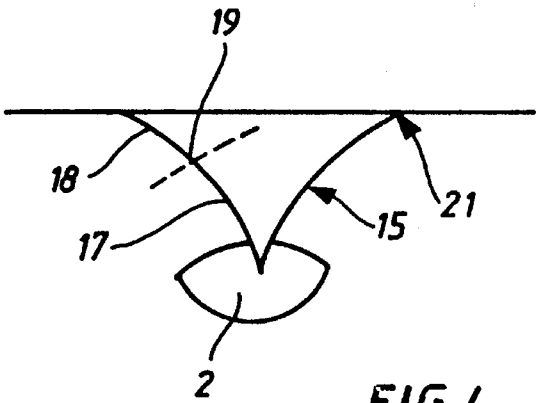
FIG. 4 shows another design of a lamp, compared to FIG. 3.

The reflector surfaces 4, 4' as well as the reflector surfaces 15 and 16 according to FIGS. 3 and 4 are curved somewhat concave. As viewed from the front, they form a more or less V-shaped profile in the manner of a swept wing.

In the embodiment shown in FIGS. 1 and 2, the outer longitudinal leading edge 14 of each reflector surface 4, 4' contacts the surface of the ceiling elements 5–11 in a smooth transition, i.e. a tangent 22 to the reflector surfaces 4 in this region is parallel to the surface of the ceiling elements 5 themselves.

FIG. 3 shows that, instead of the relatively strong curvature of the reflector surfaces 4, 4' in FIGS. 1 and 2, the reflector surfaces can also be given a steeper curvature 20, such that the transition region 21 forms an angle in the direction towards the surface of the ceiling elements, i.e., the tangent 22 to the reflector surfaces 16 in the region near the ceiling forms an angle 23 with the surface of the ceiling elements 5–11.

FIG. 4 shows that the reflector surfaces 15 can also be curved unevenly, i.e. starting from the inner longitudinal leading edges, the reflector surfaces 15 first have a relatively steep curvature 17, but, while overcoming a radius in the region of the bend 19, this goes over into a flatter curvature 18, which can go over into the ceiling surface either tangentially according to the embodiment of FIG. 2 or at an angle according to the embodiment of FIG. 3.

The transition of the reflector contour to the ceiling need not be as soft as shown in FIG. 1 and 2, but can also be discontinuous, or the reflector can be bent (FIGS. 3 and 4). However, this is contrary tithe desired pleasant lighting effect. To achieve this lighting effect, one specifically tries to design all the reflectors (including the reflector cage) in such a way that the illumination intensity is equal at all points which radiate light. However, specially shaped reflectors for achieving special lighting effects are conceivable.

Figure 5:
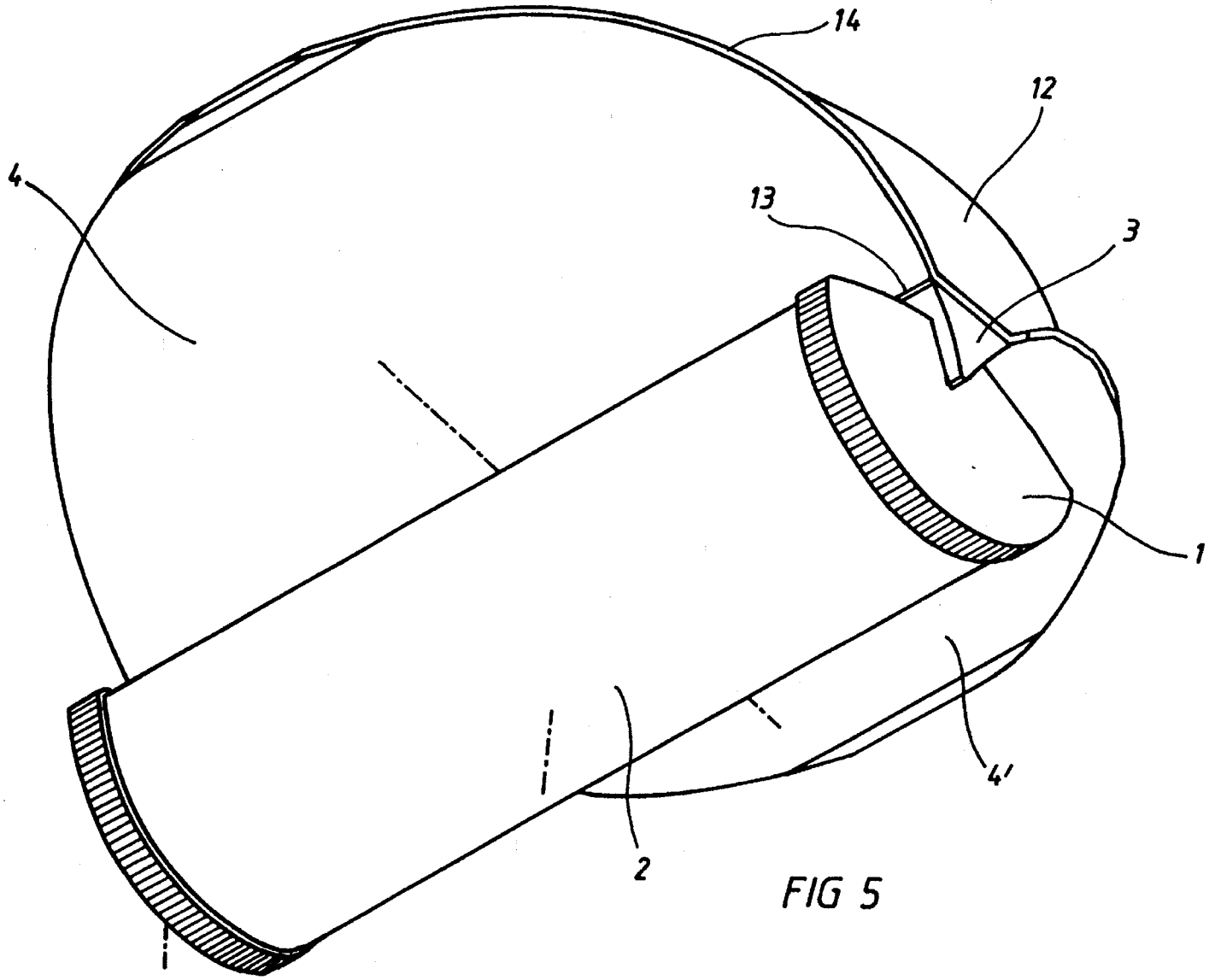
FIG. 5 shows another design of the lamp, compared to FIG. 1.

FIG. 5 shows the lamp in an embodiment with a round (oval) base surface. Compared to a rectangular shape, this has the advantage that round lamps can be used in an architecturally appealing form, regardless of the shape of the room.

The inventive lamp can also be used as a wall lamp—for this purpose, it is preferable to use shorter lighting means (e.g. 18 W fluorescent lamp with a length of 590 mm or 36 W compact fluorescent lamps with a length of 415 mm or 40 W or 55 W lamps with a length of 535 mm).

LEGEND FOR THE DRAWINGS

1 leading section of the cage 1'
2 reflector cage
3 mounting rail
4 reflector surfaces 4'
5 ceiling elements
6 ceiling elements
7 ceiling elements
8 ceiling elements
9 ceiling elements
10 ceiling elements
11 ceiling elements
12 trough part
13 longitudinal leading edge (inside)
14 longitudinal leading edge (outside)
15 reflector surfaces
16 reflector surfaces
17 curvature
18 curvature
19 bend
20 curvature
21 transition region
22 tangent

We claim:

1. A lamp with at least one oblong lighting means, which is disposed in a reflector cage, which in turn is disposed below at least two reflector surfaces, which are curved in an arc and which are disposed essentially mirror-symmetrically to one another, whose inner longitudinal leading edges extend above the reflector cage, and whose outer longitudinal leading edges are disposed outside the reflector cage, wherein the outer longitudinal leading edges of the reflector surfaces, which have a V-shaped profile, extend close to a plurality of ceiling elements to which the lamp is fastened, such that a transition region of the reflector surfaces contacts surface of the ceiling elements tangentially in the region of the outer longitudinal leading edges.

2. The lamp of claim 1, wherein the reflector surfaces have a concave curvature.

3. The lamp of claim 1, wherein a tangent of the reflector surfaces intersects the surface of the ceiling elements at an angle in the region of the outer longitudinal leading edges.

4. The lamp of claim 1, wherein the reflector surfaces are frontally covered by a trough part whose shape corresponds to the profile of the reflector surfaces.

5. The lamp of claim 1, wherein the lamp is directly fastened to a ceiling comprising said ceiling elements and the reflector surfaces lie against the ceiling.

6. The lamp of claim 1, wherein a mounting rail, to which the reflector cage is fastened, is part of the reflector surfaces.

* * * * *